US005735218A

United States Patent [19]

Fewchuk

[11] Patent Number: 5,735,218

[45] Date of Patent: Apr. 7, 1998

[54] DESK

[75] Inventor: Michael Andrew Fewchuk, Eastwood, Australia

[73] Assignee: Sebel Furniture Limited, Bankstown, Australia

[21] Appl. No.: 670,189

[22] Filed: Jun. 21, 1996

[30] Foreign Application Priority Data

Jun. 23, 1995 [AU] Australia ..... PN3768

[51] Int. Cl.[6] ..... A47B 27/00

[52] U.S. Cl. ..... 108/6; 108/9; 248/371

[58] Field of Search ..... 108/1, 6, 7, 9, 108/145; 312/235.9, 231, 233, 194, 325; 248/371, 133

[56] References Cited

U.S. PATENT DOCUMENTS

| | | | |
|---|---|---|---|
| 469,378 | 2/1892 | Schuster | 108/9 X |
| 2,328,471 | 8/1943 | Leffel | 108/6 |
| 2,979,370 | 4/1961 | Bradley et al. | 312/325 X |
| 4,040,592 | 8/1977 | Jones . | |
| 4,431,239 | 2/1984 | Vainikka | 108/1 X |
| 5,036,776 | 8/1991 | Veyhl et al. . | |
| 5,086,710 | 2/1992 | Korb . | |

FOREIGN PATENT DOCUMENTS

| | | | |
|---|---|---|---|
| 561183 | 8/1958 | Canada | 108/9 |
| 313351 | 5/1956 | France | 108/9 |
| 2330822 | 1/1975 | Germany | 312/231 |
| 527930 | 7/1955 | Italy | 108/145 |
| 700099 | 11/1979 | U.S.S.R. | 108/6 |

*Primary Examiner*—Jose V. Chen
*Assistant Examiner*—Janet M. Wilkens
*Attorney, Agent, or Firm*—Merchant, Gould, Smith, Edell, Welter & Schmidt, P. A.

[57] ABSTRACT

A school desk (1) having a frame (7) and a desk top (2) with a flat writing surface (3). The desk top (2) is pivoted at its rear edge (11) and movable between a first position in which the writing surface (3) is horizontal and a second position in which the writing surface (3) is inclined. A releasable latch maintains the writing surface (3) inclined. The latch takes the form of two linkages (16, 18) each having a first link (16) and a single common link (18) which form an over-center toggle mechanism. The latch is releasable by fingers passed through an aperture (5) in the desk top (2).

14 Claims, 3 Drawing Sheets

DESK

FIELD OF THE INVENTION

The present invention relates to furniture and, in particular, to a desk suitable for use by school pupils.

BACKGROUND OF THE INVENTION

A school desk is normally required to fulfil a number of functions. One of these functions is the provision of a flat surface which is substantially horizontal and on which the student may be asked to place various items of equipment such as a beaker of water, for example, in the event that some demonstration of experiment is being conducted.

In addition, where the student is asked to write, it is desirable for the flat surface of the desk to be inclined so that the forward edge of the flat surface is raised, thereby facilitating a less flexed lumbar spine. It is also often desirable to read from books in such an inclined position.

SUMMARY OF THE INVENTION

It is an objection of the present invention to provide a low cost desk which fulfils both these requirements.

In accordance with the first aspect of the present invention there is disclosed a school desk comprising a frame and a desk top having a flat wiring surface, wherein said desk top is pivotally mounted on said frame and is movable between a first position in which said writing surface is substantially horizontal and a second position in which said writing surface is upwardly forwardly inclined, and wherein said desk includes releasable latch means to retain said desk top in said inclined second position.

Preferably the desk top is pivoted on said frame adjacent to the rear edge thereof, and said releasable latch means comprises a pair of pivoted link over-centre toggle mechanisms rigidly connected so as to work in unison.

BRIEF DESCRIPTION OF THE DRAWINGS

One embodiment of the present invention will now be described with reference to the drawings in which.

DETAILED DESCRIPTION OF THE PREFERRED EMBODIMENT

Figure 1:
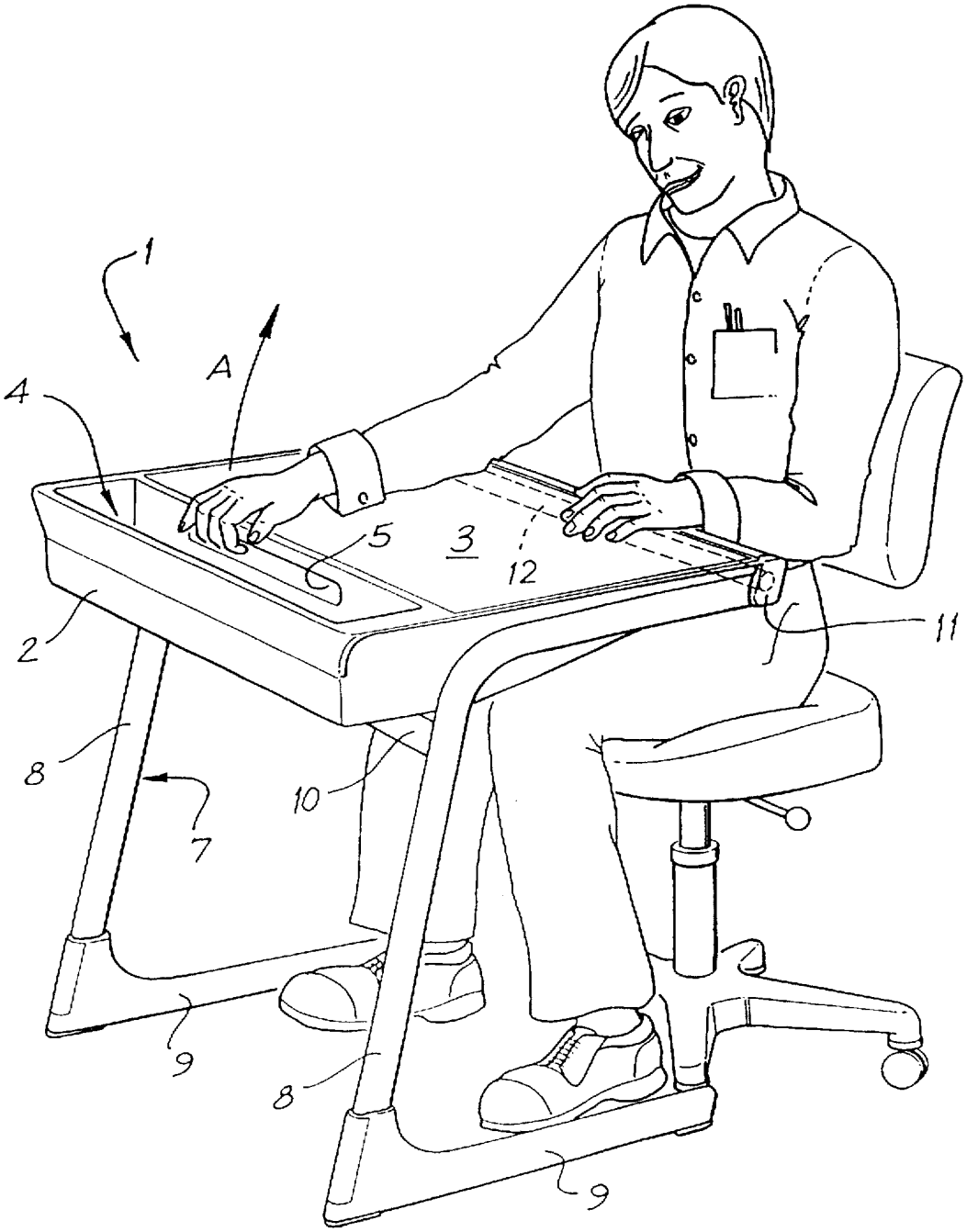
FIG. 1 is a front perspective view of the desk of the preferred embodiment and illustrates a student sitting at the desk.
Figure 2:
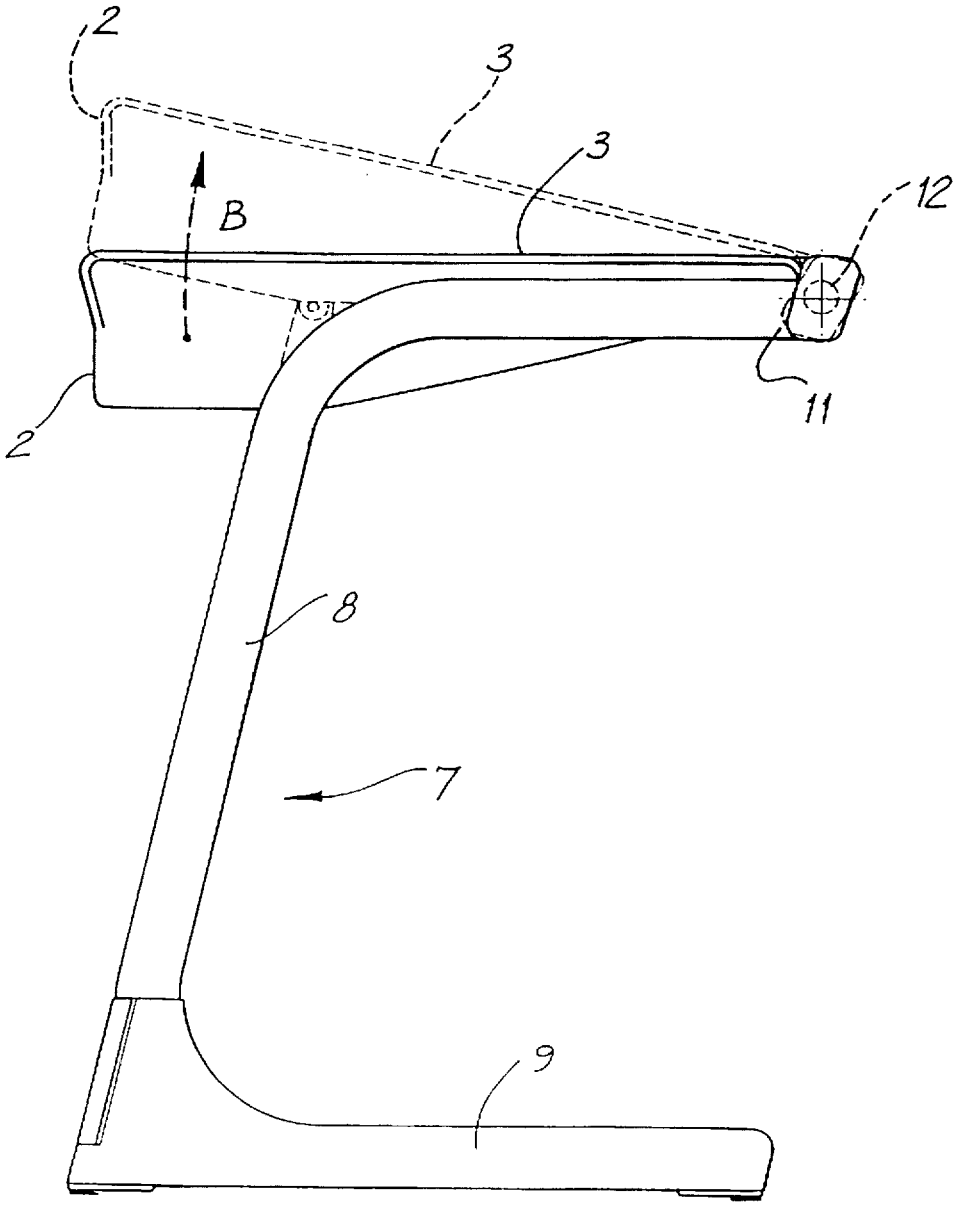
FIG. 2 is a side elevational view of the desk showing the inclined position of the desk top illustrated by means of broken lines.

As seen in FIGS. 1 and 2, the desk 1 of the preferred embodiment comprises a desk top 2 having a flat writing surface 3. The writing surface 3 extends to the rearward edge of the desk and extends forwardly towards a trough 3 which is used as a receptacle for books, folders, pencils, a ruler, and like implements (not illustrated). The rear wall of the trough is provided with an aperture 5 through which the fingers of the student can be inserted as illustrated in FIG. 1.

The desk 1 also includes a metal frame 7 having two side legs 8 each with a corresponding foot 9. Between the side legs 8 and below the desk top 2 extends a cross-bar 10, and another cross-bar 12 of tube having a circular cross-section at the rear end of the desk.

As best seen in FIG. 2, the desk top 2 is pivoted about the cross-bar 12 at its rearward edge at the rear upper extremities 11 of the frame 7. This pivotal mounting permits the desk top 2 to be moved between a first position illustrated by solid lines in FIG. 2 in which the writing surface 3 is substantially horizontal, and a second position illustrated by broken lines in FIG. 2 in which the writing surface 3 is inclined with the forward edge of the writing surface being raised relative to the rear extremities 11.

Figure 3:
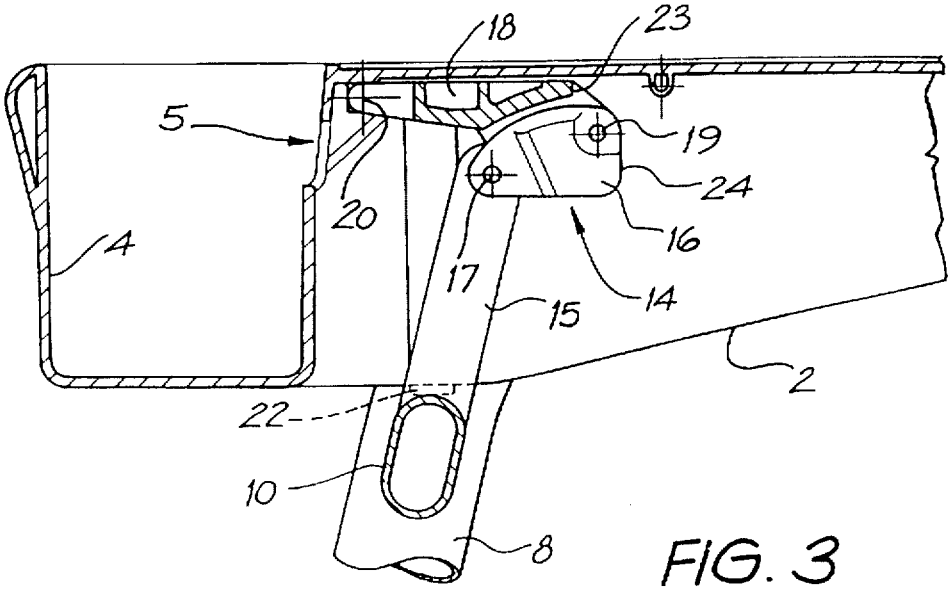
FIGS. 3 and 4 are each partial vertical cross sectional views through the desk illustrating the interior linkage mechanism.
Figure 4:
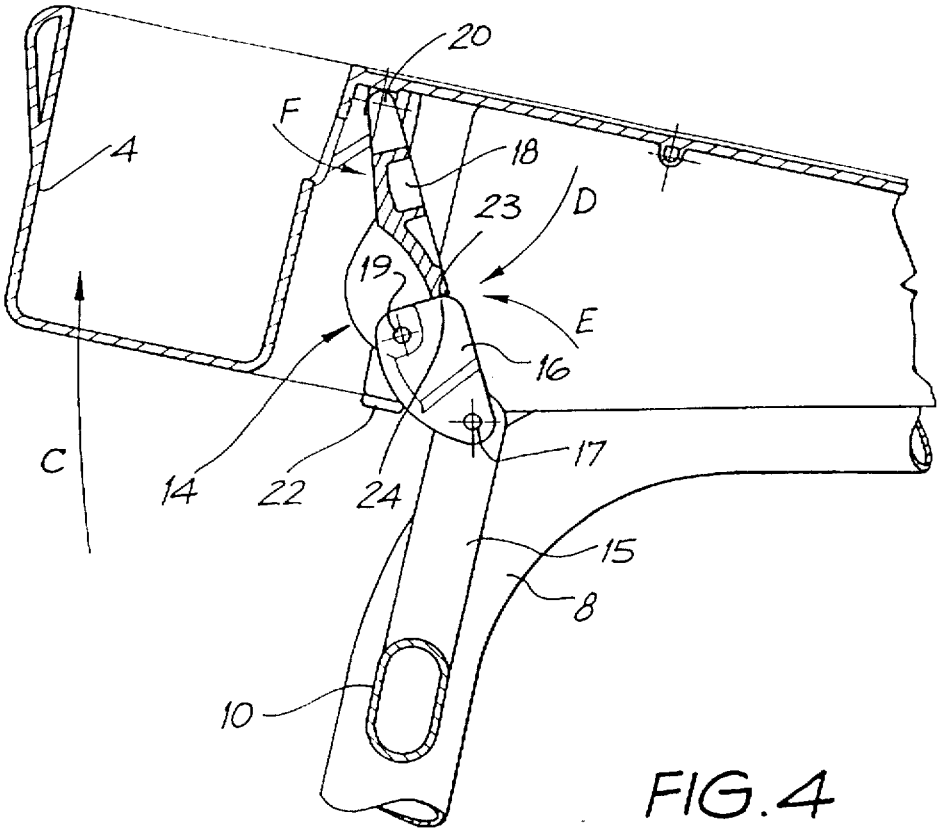

FIGS. 3 and 4 illustrate one of the two identical linkage mechanisms which support each side of the desk top 2 above the cross-bar 10. Extending above the cross-bar 10 at each side of the desk is a fixed strut 15 at the upper end of which a first, short, link 16 is pivoted at 17. The free end of each of the pair of first links 16 is pivoted to a corresponding end of a second, longer, link 18 so that both the first and second links 16, 18 pivot about pivot 19. The single link 18 extends between opposite sides of the desk. The pivot joint area at the end of the link 18 is shown hatched in the cross-sectional views of FIGS. 3 and 4. Finally, the two ends of the second link 18 are each pivoted at 20 to the underside of the writing surface 3.

In the position illustrated in FIG. 3, the links 16 and 18 are pivoted to lie alongside each other and the desk top 2 is supported on the cross-bar 10 by engagement of two bosses 22 (only one of which is illustrated in FIGS. 3 and 4) on the upper surface of the cross-bit 10. As a consequence, the desk top 2 is firmly supported in the lower (horizontal) position.

If the student places his fingers into the aperture 5 as illustrated in FIG. 1, and raises the forward edge of the writing surface 3 upwardly as indicated by the arrow A in FIG. 1, then the desk top 2 is pivoted as indicated by arrow B from the position illustrated in FIG. 2 in solid lines, into the position illustrated in FIG. 2 by broken lines. As a consequence, the linkage mechanism 14 moves from the position illustrated in FIG. 3 into the position illustrated in FIG. 4. In order to accomplish this movement the second link 18 pivots in a clockwise direction about pivot 20 as indicated by arrow D in FIG. 4 thereby moving both the pivot 19 and the first link 16 in an anti-clockwise direction as indicated by arrow E in FIG. 4. This movement places the first and second links 16, 18 essentially "in line" and, after further pivoting, brings into engagement two abutment surfaces 23 and 24.

The lengths of the links 16 and 18 and the position of the pivot 19 and abutment surfaces 23, 24 are selected so that in the configuration illustrated in FIG. 4 the linkage mechanism 14 is placed in a slightly over centre toggle position. As a consequence, downward forces exerted on the desk top 2 and, in particular, on the writing surface 3, drive the abutment surfaces 23 and 24 towards each other. As a consequence, the desk top 2 is effectively latched into the inclined position illustrated in broken lines in FIG. 2.

In order to release the desk top 2 from the inclined position, the student places his fingers through the aperture 5 as illustrated in FIG. 1. The fingers are moved in the direction of arrow F in FIG. 4 so as to move the second link 18 a small distance in the anti-clockwise direction (opposite to the direction of arrow D in FIG. 4) thereby moving the linkage mechanism 14 out of its over-centre position. As a consequence, the first and second links 16, 18 are free to pivot in the directions opposite to arrows D and E in FIG. 4 so as to return the links 16, 18 into the position illustrated in FIG. 3. This motion also permits free motion of the desk top 2 under the force of gravity into the position illustrated in FIG. 3.

It will be apparent to those skilled in the an that the longitudinal extent of the aperture 5 is restricted so that the student is only able to place his fingers so as to come into contact with the central region of the second link 18. The second link 18 has a substantial extent parallel to the cross-bar 10 and extends from one side of the desk 1 to the other. However, the pair of fixed struts 15 and first links 16 are each located adjacent the corresponding side edges of the desk 1 and are therefore well away from the aperture 5. As a consequence, it is not possible for the student's fingers to become caught or pinched between any of the pivoting portions.

The foregoing describes only one embodiment of the present invention and modifications, obvious to those skilled in the art, can be made thereto without departing from the scope of the present invention.

I claim:

1. A school desk comprising a frame and a desk top having a flat writing surface, wherein said desk top is pivotally mounted on said frame and is movable between a first position in which said writing surface is substantially horizontal and a second position in which said writing surface is upwardly forwardly inclined, said desk includes releasable latch means comprising a pair of piloted link over-centre toggle mechanisms connected to work in unison to retain said desk top in said inclined second position, each of said link mechanisms is spaced apart and located adjacent opposite sides of the desk and interconnected by a common link member extending between said pair of mechanisms, and wherein each said link mechanism comprises a first link and said common link member pivoted together to form said pivoted link over-centre toggle mechanism and each of said first link and said common link member has an abutment surface, said abutment surfaces being engageable with each other when said links are pivoted into an over-centre toggle position, said desk top being supported in said inclined position by means of said abutment surface engagement.

2. A desk as claimed in claim 1 wherein the disk top is pivoted on said frame adjacent to the rear edge thereof.

3. A desk as claimed in claim 1 wherein said desk top occludes said pair of mechanisms from view and includes an aperture located intermediate said mechanisms and through which the fingers of an operator can be pushed to touch said common link member.

4. A desk as claimed in claim 3 wherein said link mechanisms are releasable from said over-centre toggle position by said fingers pushing said common link member to move the abutment surfaces thereof out of engagement with the abutment surfaces of said first links and to move said link mechanisms past the centre of their said over-centre toggle position.

5. A desk as claimed in claim 4 wherein with said abutment surfaces not engaged said desk top is supported in said first position by engagement of said desk top with said frame.

6. A desk as claimed in claim 5 wherein said frame includes a cross bar extending across said frame below said desk and an underside of said desk top engages said cross bar in said first position.

7. A school desk comprising a frame and a desk top having a flat writing surface, wherein said desk top is pivotally mounted on said frame and is movable between a first position in which said writing surface is substantially horizontal and a second position in which said writing surface is upwardly forwardly inclined, and wherein said desk includes releasable latch means comprising a pair of pivoted link over-centre toggle assemblies, said assemblies being substantially rigidly connected to each other so as to pivot in unison to retain said desk top in said inclined second position.

8. A desk as claimed in claim 7 wherein the desk top is pivoted on said frame adjacent to the rear edge thereof.

9. A desk as claimed in claim 7 wherein each of said link assemblies is spaced apart and located adjacent opposite sides of the desk and rigidly interconnected by a common link member extending between said pair of assemblies.

10. A desk as claimed in claim 9 wherein said desk top occludes said pair of assemblies from view and includes an aperture located intermediate said assemblies and through which the fingers of an operator can be pushed to touch said common link member.

11. A desk as claimed in claim 10 wherein each said link assembly comprises a first link and said common link member paroled together to form said pivoted link over-centre toggle assembly and each of said first link and said common link member has an abutment surface, said abutment surfaces being engageable with each other when said links are pivoted into an over-centre toggle position, said desk top being supported in said inclined position by means of said abutment surface engagement.

12. A desk as claimed in claim 11 wherein said link assemblies are releasable from said over-centre toggle position by said fingers pushing said common link member to move the abutment surfaces thereof out of engagement with the abutment surfaces of said first links and to move said link assemblies past the centre of their over-centre toggle position.

13. A desk as claimed in claim 12 wherein with said abutment surfaces not engaged said desk top is supported in said first position by engagement of said desk top with said frame.

14. A desk as claimed in claim 7 wherein said flame includes a cross bar extending across said frame below said desk and an underside of said desk top engages said cross bar in said first position.

* * * * *

UNITED STATES PATENT AND TRADEMARK OFFICE

CERTIFICATE OF CORRECTION

PATENT NO. : 5,735,218

DATED : APRIL 7, 1998

INVENTOR(S) : FEWCHUK

It is certified that error appears in the above-identified patent and that said Letters Patent is hereby corrected as shown below:

At column 1, line 58, please change "3" to —4—.

At column 2, line 27, please change "cross–bit" to —cross–bar—.

At column 3, line 1, please change "an" to —art—.

At column 3, in claim 1, line 23, please change "piloted" to —pivoted—.

At column 4, in claim 11, line 30, please change "paroled" to —pivoted—.

At column 4, in claim 14, line 48, please change "flame" to —frame—.

Signed and Sealed this

Twenty-third Day of February, 1999

*Attest:*

Q. TODD DICKINSON

*Attesting Officer*

*Acting Commissioner of Patents and Trademarks*